US007032735B2

(12) United States Patent
Trenner

(10) Patent No.: US 7,032,735 B2
(45) Date of Patent: Apr. 25, 2006

(54) COIN SLOT FOR A MECHANICAL COIN-ACCEPTOR UNIT AND MECHANICAL COIN-ACCEPTOR UNIT HAVING A COIN SLOT

(75) Inventor: Christian Trenner, Berlin (DE)

(73) Assignee: Walter Hanke - Mechanische Werkstatten GmbH & Co. KG, Berlin (DE)

( * ) Notice: Subject to any disclaimer, the term of this patent is extended or adjusted under 35 U.S.C. 154(b) by 258 days.

(21) Appl. No.: 10/649,963

(22) Filed: Aug. 27, 2003

(65) Prior Publication Data

US 2004/0182679 A1 Sep. 23, 2004

(30) Foreign Application Priority Data

Mar. 21, 2003 (DE) ..... 103 13 810

(51) Int. Cl.
*G07F 1/04* (2006.01)

(52) U.S. Cl. ..... 194/344; 193/DIG. 1

(58) Field of Classification Search ..... 194/344, 194/325, 326, 327, 351; 193/DIG. 1; 206/815; 453/18, 39, 63; 446/8, 9, 10, 11, 12, 13
See application file for complete search history.

(56) References Cited

U.S. PATENT DOCUMENTS 4,545,474 A 10/1985 Ridley et al. ..... 194/1 E
4,687,090 A * 8/1987 Ramseier ..... 194/317
5,139,128 A * 8/1992 Carmen et al. ..... 194/343

FOREIGN PATENT DOCUMENTS

DE 695 05 139 T2 4/1999
EP 0.042.662 A1 * 12/1981

* cited by examiner

*Primary Examiner*—Donald P. Walsh
*Assistant Examiner*—Mark J. Beauchaine
(74) *Attorney, Agent, or Firm*—Baker Botts L.L.P.

(57) ABSTRACT

A coin slot for a mechanical coin-acceptor unit and a mechanical coin-acceptor unit having a coin slot aperture incorporated in a front plate, a coin slot chamber and a coin channel are proposed, the coin channel being offset relative to the coin slot aperture and the coin slot chamber having a shoulder behind the coin slot aperture in the insertion direction. The shoulder is configured so as to vibrate as a coin reflector or membrane in such a manner that an impacting inserted coin in the coin slot chamber is reflected by the shoulder elastically in the direction of the front plate and experiences, in the coin slot chamber, a renewed reversal of direction in the direction of the coin channel.

20 Claims, 3 Drawing Sheets

COIN SLOT FOR A MECHANICAL COIN-ACCEPTOR UNIT AND MECHANICAL COIN-ACCEPTOR UNIT HAVING A COIN SLOT

PRIORITY

This application claims foreign priority of the German application DE 103 13 810.2 filed on Mar. 21, 2003.

TECHNICAL FIELD OF THE INVENTION

The invention relates to a coin slot for a mechanical coin-acceptor unit and a mechanical coin-acceptor unit having a coin slot.

BACKGROUND OF THE INVENTION

Mechanical coin-acceptor units are generally known, reference is made for example to U.S. Pat. No. 4,545,474 in which a mechanical coin-acceptor unit is mounted on a front plate arrangement. This coin-acceptor unit has a first and a second coin track, an opening being present between them. In this known arrangement, a shoulder or a stop member is situated in the first coin track, onto which an inserted coin rolling in the running direction impacts, then tilts to the side and continues its path further on the offset first coin track and if necessary is directed through the opening into the second coin track. Such a shoulder or step serves normally as manipulation protection in order that for example a wire introduced into the coin slot aperture or another tool cannot destroy the checking devices of the mechanical coin-acceptor unit.

It has been shown that such a shoulder does not function with any arbitrary coin slot arrangements, for example it can occur that an inserted coin, which falls on the shoulder, remains there. This prevents a friction-free function of the coin-acceptor unit.

SUMMARY OF THE INVENTION

The object therefore underlying the invention is to produce a coin slot for a mechanical coin-acceptor unit or a mechanical coin-acceptor unit having a coin slot, in which, despite a shoulder in the path of the coin, perfect forwarding of the coin into the coin channel which has the checking devices is ensured.

This object can be achieved by a coin slot for a mechanical coin-acceptor unit, comprising a coin slot aperture, which is incorporated in a front plate, a coin slot chamber and a coin channel, the coin channel being offset relative to the coin slot aperture and the coin slot chamber having a shoulder behind the coin slot aperture in the insertion direction, wherein the shoulder is configured so as to vibrate as a coin reflector in such a manner that an impacting inserted coin in the coin slot chamber is reflected by the shoulder elastically in the direction of the front plate and, in the coin slot chamber, experiences a renewed reversal of direction in the direction of the coin channel.

The object can also be achieved by a mechanical coin-acceptor unit with a coin slot comprising a coin slot aperture, which is incorporated in a front plate, a coin slot chamber and a coin channel, the coin channel being offset relative to the coin slot aperture and the coin slot chamber having a shoulder behind the coin slot aperture in the insertion direction, wherein the shoulder is configured so as to vibrate as a coin reflector in such a manner that an impacting inserted coin in the coin slot chamber is reflected by the shoulder elastically in the direction of the front plate and, in the coin slot chamber, experiences a renewed reversal of direction in the direction of the coin channel, wherein the coin channel having various checking devices, in the direction of movement of the coin, for checking parameters of the coin in a lateral delimiting wall, an acknowledgement and acceptance region for valid coins being provided at the end of the coin channel and a longitudinal opening, situated opposite the lateral delimiting wall, being disposed over a substantial part of the coin channel, through which opening coins which have not to be accepted fall into a return shaft.

The coin slot chamber may have a height which is substantially greater than the height of the insertion aperture and the insertion aperture in the front plate may be configured in the upper region of the coin slot chamber in such a manner that an inserted coin falls downwardly in an arcuate manner and impacts against the coin reflector and falls further downwardly counter to the insertion direction until it hits the front plate and/or the base of the coin slot chamber and/or experiences a reversal of direction due to gravity. In order to achieve the vibrating coin reflector, the transition regions of the shoulder to a side wall of the coin slot chamber and to a side wall of the coin channel can be provided with clearances. In the transition regions, the clearances can be configured as apertures formed at the height of the coin slot chamber. The shoulder may comprise a flexible material. The shoulder may comprise a tongue extending in the vertical direction of the coin slot chamber, as coin deflector.

As a result of the fact that the shoulder is configured so as to vibrate as a coin reflector, the coin receives an impulse when it impacts on the shoulder which is imparted such that the coin is reflected specifically with a change of direction, a clean transition into the coin channel disposed offset to the insertion aperture occurring due to gravity and/or renewed deflection at the front plate and/or at the base. Due to the vibrating coin reflector, the coin receives a dynamic impact, as a result of which the coin is prevented from remaining on the shoulder after impact. The coin adopts a uniform course through the coin track, as a result of which the surveying of the coin at the coin checking devices is more precise.

Advantageous developments and improvements are possible by means of the measures indicated in the sub-claims.

The vibrating coin reflector can be produced in the most varied of ways. On the one hand, the vibrating coin reflector can be an integral component of the wall of the coin slot chamber, the vibrating properties being imparted to the shoulder in this case as a result of the fact that the shoulder is provided in its edge regions with clearances so that a type of web is produced. These clearances can be configured in the most varied of ways, in the preferred example slots are provided which extend in the vertical direction. Only a narrow material web remains which connects the shoulder respectively to the adjacent wall. As a result, the shoulder is suspended so as to vibrate and endows it with the desired impulse properties.

On the other hand, an additional spring element, for example made of sheet metal or spring steel, can be mounted on the shoulder such that a resilient tongue which is formed in vertical direction is produced.

BRIEF DESCRIPTION OF THE DRAWINGS

One embodiment of the invention is illustrated in the drawing and is explained in more detail in the subsequent description. There are shown.

DETAILED DESCRIPTION OF THE PREFERRED EMBODIMENTS

Figure 1:
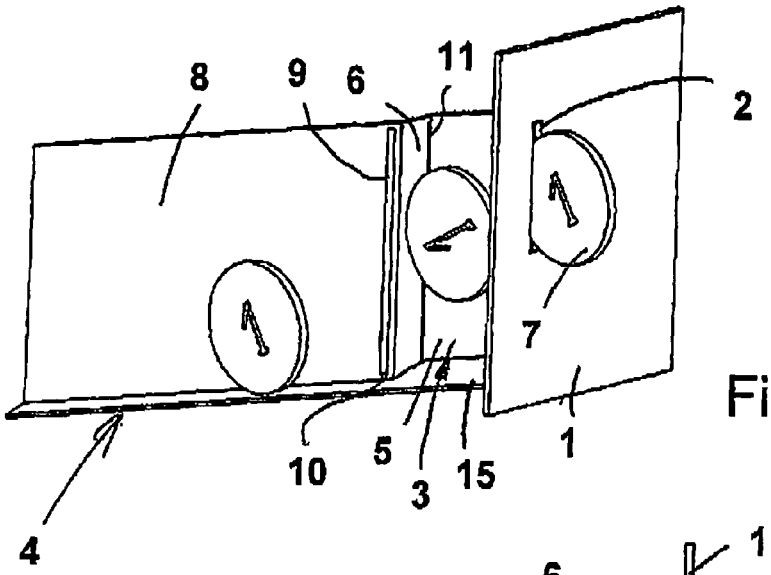
FIG. 1 a perspective schematic view of the coin slot according to the invention, in which one of the lateral limits of the coin slot chamber and of the coin channel is left out, FIG. 2 a side view of the embodiment according to FIG. 1, FIG. 3 a section through the coin slot according to FIG. 2 corresponding to the section line A–D, Z being a detail which is illustrated in an enlarged fashion, FIG. 4 a perspective schematic view of a coin slot with another embodiment of the shoulder, FIG. 5 a side view of the coin slot according to FIG. 4, and FIG. 6 a perspective side view of a coin-acceptor unit with coin reflector.

A basic body 20 is mounted on a front plate 1 and has a coin checking region 21, an acceptance region 22 abutting thereon and a return region 23. The basic body 20 is multi-part and comprises a base plate 24 with recesses for checking devices, a flap 26 which is mounted pivotably on the base plate 24 via a spring element 25, and also a return shaft 27, which is mounted resiliently on the base plate and discharges in a return aperture 28 in the front plate 1. A return button 29 is formed in order to lift the flap 26, in opposition to the force of the spring element 25, from the base plate 24 in order that any coins which are stuck can fall into the return shaft 27.

Figure 6:
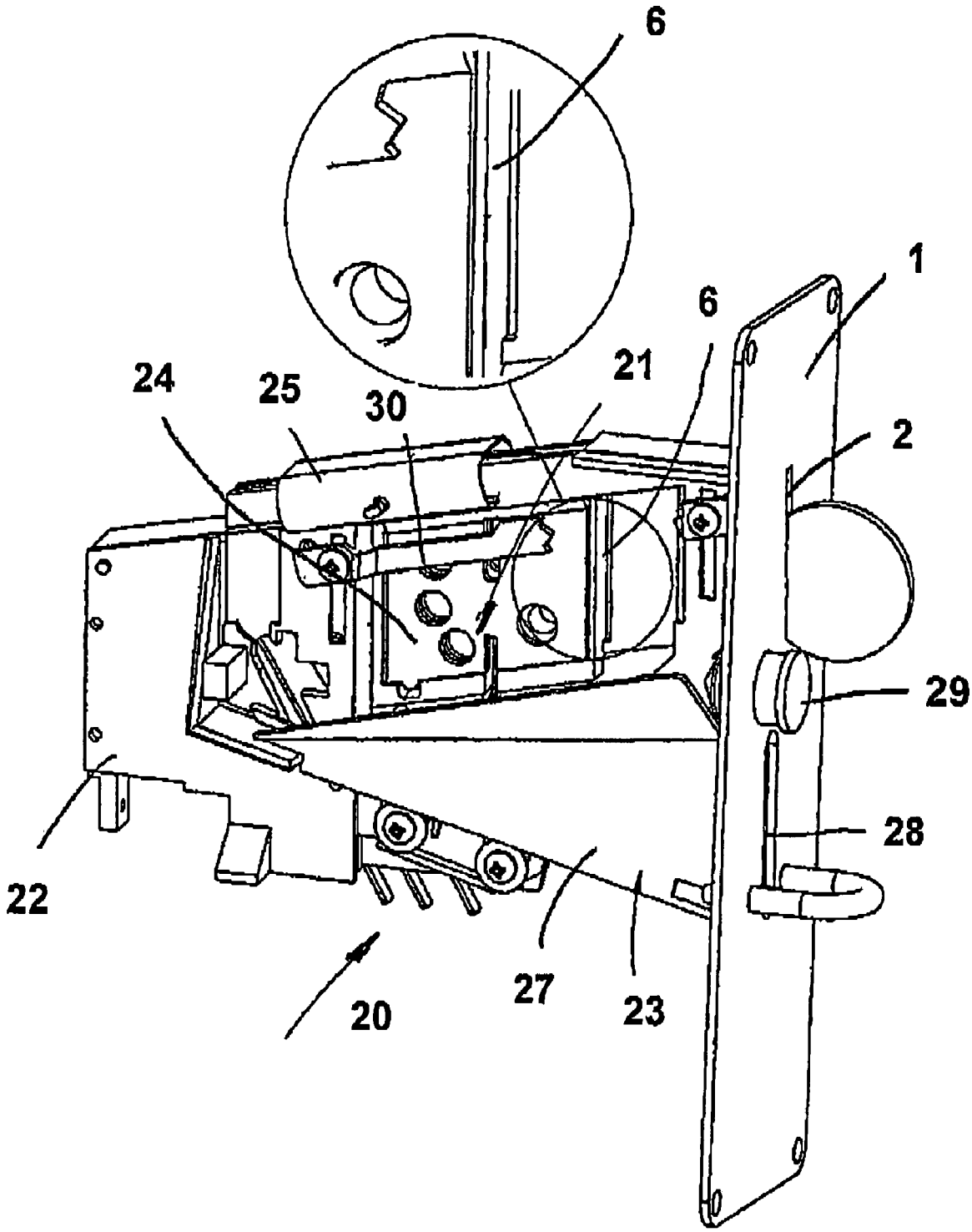

The coin channel 4 or the coin track, which is described further on in more detail, is inclined slightly diagonally downwardly, in FIG. 6 to the left, and is delimited on the one hand as side wall 8 (see FIG. 1) by the base plate 24 and on the other hand by an upper rail 30 which is partly broken away and is connected to the flap 26. The upper rail 30 together with the coin rolling track 15, which forms the base of the coin channel 4, and with the lower limit, not shown in more detail (it is left out in part for the sake of clarity), of the flap 26 serves for checking the diameter of the coin. The coin rolling track 15, as already noted above, is inclined slightly downwardly but it also has an inclination to the front in the drawing plane so that any passing coins experience an inclination force against the upper rail 30. The lower limit of the flap 26 terminates at least in the checking region for instance with the coin rolling track 15.

The coin slot region provided behind an insertion aperture 2 is described in more detail in the following.

A mechanical coin-acceptor unit having a coin slot according to FIG. 1 is illustrated in FIG. 6.

The coin slot illustrated in FIG. 1 has the front plate 1 on which the mechanical coin-acceptor unit is normally mounted. In FIG. 1, only the insertion region of the coin-acceptor unit can be seen, which region has a coin slot chamber 3 configured behind the insertion aperture 2 provided in the front plate 1 and has the coin channel 4. The coin slot chamber is provided with a side wall 5, a coin rolling rail 15 forming the base, and a shoulder 7. The front side wall is left out in FIG. 1 for the sake of the illustration, strips or partial coverings also being intended to be understood by side wall.

The insertion aperture 2 is provided in the upper region with respect to the height of the coin slot chamber 3, the shoulder 16 being disposed behind the insertion aperture 2 in the direction of movement of the coin 7 and being approximately at right angles to the side wall 5. The shoulder 6 merges into a side wall 8 of the coin channel 4 and in fact at an angle of approximately 90°.

As can be detected from FIG. 1, the side wall 8 of the coin channel 4 is provided in the region of the shoulder 6 with an elongated aperture 9 extending in the vertical direction of the coin slot chamber 3, said aperture leaving only two narrow material webs 10 in the side wall 8. A corresponding aperture 11 is provided at the transition point between the side wall 5 of the insertion chamber 3 and shoulder 6 in the vertical direction. Due to the apertures 9 and 11, the shoulder 6 obtains a vibrating property as is explained further on. The shoulder 6 can be described as a coin reflector or also as a membrane.

Figure 2:
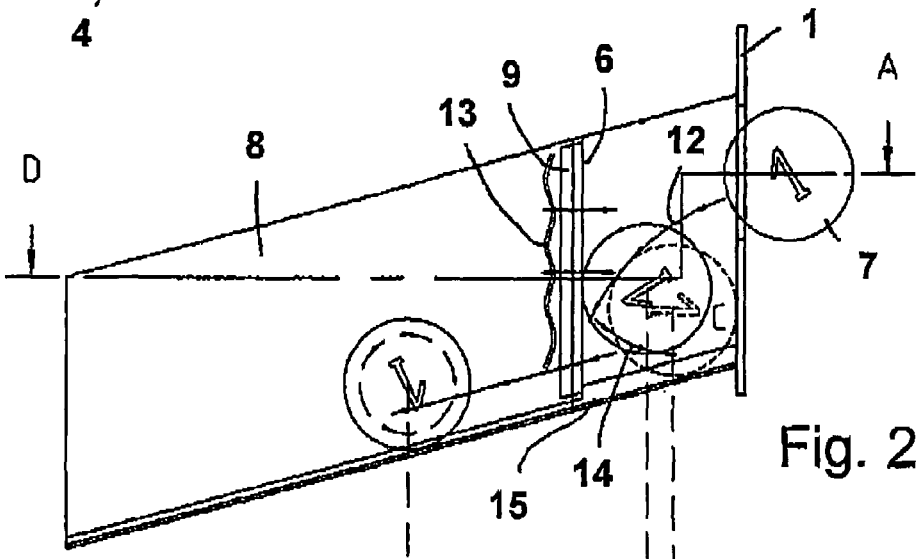

In FIG. 2, the side view of the coin slot according to FIG. 1 is illustrated, here also the flight curve of a coin 7 inserted through the coin slot aperture 2 being explained by arrow illustrations. The coin 7 is inserted into the aperture 2 in the upper region of the insertion chamber 3, the flight curve being arcuate under the effect of gravity, as is indicated by the arrows 12. An inserted coin 7 falls in an arcuate fashion (12) against the shoulder 6 which is configured as coin reflector, the point of impact being positioned somewhat underneath the aperture 2. The point of impact is however variable and depends also upon the type of introduction of the coin 7 into the aperture 2. As indicated in FIG. 2 by the perpendicularly indicated vibration curve 13, vibrations arise due to the impact of the coin 7 on the shoulder 6.

Figure 3:
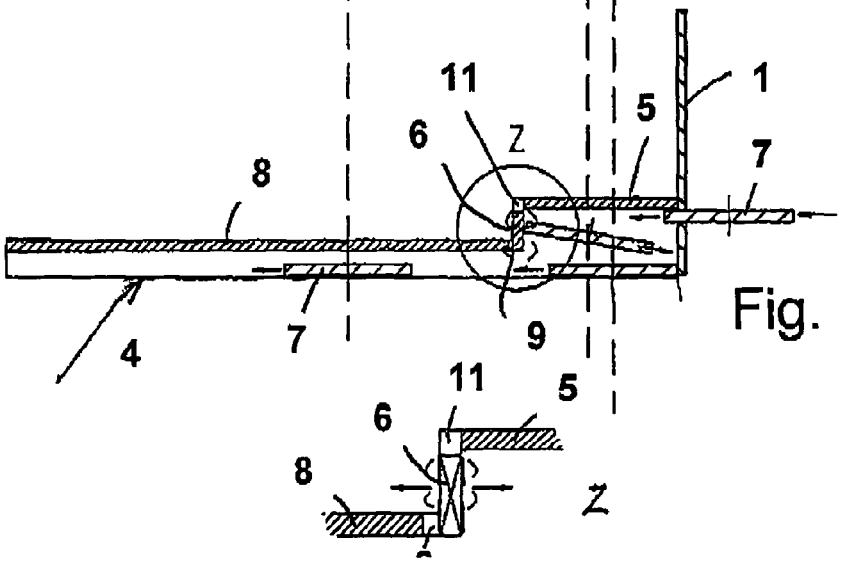

In FIG. 3, a section of FIG. 2 corresponding to the section line A–D is provided. It can be very readily detected in this Figure that the shoulder 6 lies in the direction of movement of the coin 7 directly behind the insertion aperture 2 in the front plate 1. The coin hitting the shoulder 6 receives a dynamic impulse due to the vibrations 13 and the coin changes its direction of movement and is reflected on the shoulder 6 corresponding to the arc curve 14. The coin 7 can thereby again hit the front plate 1 and/or against the base 15 of the insertion chamber 3. In many cases, it does not pass back to the front plate 1 but experiences a reversal of direction due to gravity and/or the force caused by the inclination of the coin rolling rail 15 in two directions. After renewed change of direction, the coin 7 is in alignment to the coin channel 4 and rolls along the latter in its slightly diagonally inclined disposition through the corresponding checking devices.

In FIG. 3, the coin 7 is illustrated vertically in the aperture 2. Normally, the aperture 2 is slightly laterally inclined.

The detail Z in FIG. 3 shows an enlarged detail of the shoulder 6 with the adjacent apertures 9, 11, the two arrows being intended to indicate the vibrations of the shoulder 6.

It is hence ensured due to the shoulder 6 on the one hand that no elongated tool, such as a wire, a metal sheet or cardboard strip or the like passes into the coin channel, which could lead to destruction of the checking devices but also could push stuck coins with force through the acknowledgement and acceptance region and, on the other hand, an impacting coin is controlled in its movement by the dynamic behavior of the shoulder 6 such that it remains in motion but is simultaneously directed into the coin channel 4 in a settled manner.

Figure 4:
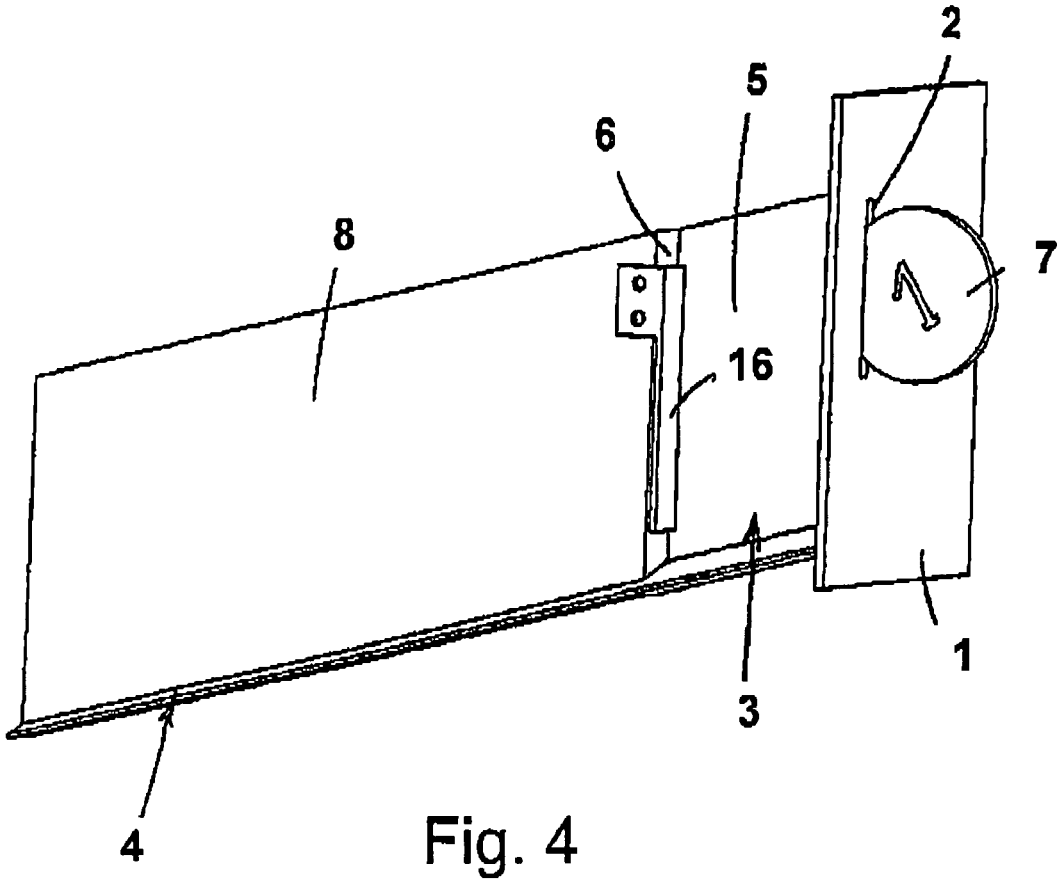
Figure 5:
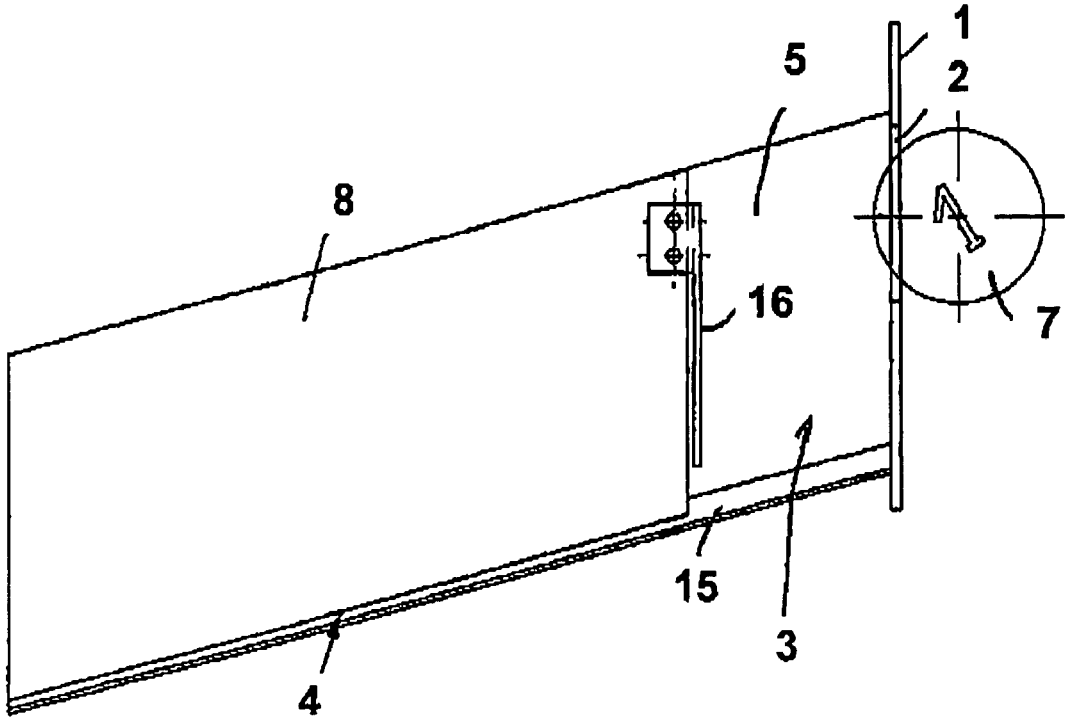

A further embodiment of a vibrating coin reflector is illustrated schematically in FIGS. 4 and 5. Here also, the coin slot chamber 3 is provided with the shoulder behind the front plate 1, forming a step, the shoulder to the side wall of the coin slot chamber adopting for instance an angle of 90°. The shoulder merges after renewed change in direction of approximately 90° into the side wall 8 of the coin channel 4. In this embodiment, no clearances or recesses are provided on the edge regions of the shoulder 6, which is connected in the upper region to the side wall 8. This spring element 16, which is configured as a strip-shaped tongue, hence represents the vibrating coin reflector. Otherwise, the mode of operation of the coin reflector 16 is just as was described in connection with the first embodiment.

Other suspensions or mounting possibilities of the spring element 16 are of course possible, they should be configured only such that they do not disturb the vibrating character of the coin reflector and the course of the coin 7.

The invention claimed is:

1. Coin slot for a mechanical coin-acceptor unit, comprising a coin slot aperture, which is incorporated in a front plate, a coin slot chamber and a coin channel, the coin channel being offset relative to the coin slot aperture and the coin slot chamber having a shoulder behind the coin slot aperture in the insertion direction, wherein the shoulder is configured so as to vibrate as a coin reflector in such a manner that an impacting inserted coin in the coin slot chamber is reflected by the shoulder elastically in the direction of the front plate and, in the coin slot chamber, experiences a renewed reversal of direction in the direction of the coin channel.

2. Coin slot according to claim 1, wherein the coin slot chamber has a height which is substantially greater than the height of the insertion aperture and the insertion aperture in the front plate is configured in the upper region of the coin slot chamber in such a manner that an inserted coin falls downwardly in an arcuate manner and impacts against the coin reflector and falls further downwardly counter to the insertion direction until it hits the front plate and/or the base of the coin slot chamber and/or experiences a reversal of direction due to gravity.

3. Coin slot according to claim 1, wherein, in order to achieve the vibrating coin reflector, the transition regions of the shoulder to a side wall of the coin slot chamber and to a side wall of the coin channel are provided with clearances.

4. Coin slot according to claim 2, wherein, in order to achieve the vibrating coin reflector, the transition regions of the shoulder to a side wall of the coin slot chamber and to a side wall of the coin channel are provided with clearances.

5. Coin slot according to claim 3, wherein, in the transition regions, the clearances are configured as apertures formed at the height of the coin slot chamber.

6. Coin slot according to claim 4, wherein, in the transition regions, the clearances are configured as apertures formed at the height of the coin slot chamber.

7. Coin slot according to claim 1, wherein the shoulder comprises a flexible material.

8. Coin slot according to claim 7, wherein the shoulder comprises a tongue extending in the vertical direction of the coin slot chamber, as coin deflector.

9. Mechanical coin-acceptor unit with a coin slot comprising a coin slot aperture, which is incorporated in a front plate, a coin slot chamber and a coin channel, the coin channel being offset relative to the coin slot aperture and the coin slot chamber having a shoulder behind the coin slot aperture in the insertion direction, wherein the shoulder is configured so as to vibrate as a coin reflector in such a manner that an impacting inserted coin in the coin slot chamber is reflected by the shoulder elastically in the direction of the front plate and, in the coin slot chamber, experiences a renewed reversal of direction in the direction of the coin channel, wherein the coin channel having various checking devices, in the direction of movement of the coin, for checking parameters of the coin in a lateral delimiting wall, an acknowledgement and acceptance region for valid coins being provided at the end of the coin channel and a longitudinal opening, situated opposite the lateral delimiting wall, being disposed over a substantial part of the coin channel, through which opening coins which have not to be accepted fall into a return shaft.

10. The mechanical coin-acceptor unit according to claim 9, wherein the coin slot chamber has a height which is substantially greater than the height of the insertion aperture and the insertion aperture in the front plate is configured in the upper region of the coin slot chamber in such a manner that an inserted coin falls downwardly in an arcuate manner and impacts against the coin reflector and falls further downwardly counter to the insertion direction until it hits the front plate and/or the base of the coin slot chamber and/or experiences a reversal of direction due to gravity.

11. The mechanical coin-acceptor unit according to claim 9, wherein, in order to achieve the vibrating coin reflector, the transition regions of the shoulder to a side wall of the coin slot chamber and to a side wall of the coin channel are provided with clearances.

12. The mechanical coin-acceptor unit according to claim 10, wherein, in order to achieve the vibrating coin reflector, the transition regions of the shoulder to a side wall of the coin slot chamber and to a side wall of the coin channel are provided with clearances.

13. The mechanical coin-acceptor unit according to claim 11, wherein, in the transition regions, the clearances are configured as apertures formed at the height of the coin slot chamber.

14. The mechanical coin-acceptor unit according to claim 12, wherein, in the transition regions, the clearances are configured as apertures formed at the height of the coin slot chamber.

15. The mechanical coin-acceptor unit according to claim 9, wherein the shoulder comprises a flexible material.

16. The mechanical coin-acceptor unit according to claim 15, wherein the shoulder comprises a tongue extending in the vertical direction of the coin slot chamber, as coin deflector.

17. Coin slot for a mechanical coin-acceptor unit, comprising a coin slot aperture, which is incorporated in a front plate, a coin slot chamber and a coin channel, the coin channel being offset relative to the coin slot aperture and the coin slot chamber having a shoulder behind the coin slot aperture in the insertion direction, wherein the shoulder is configured so as to vibrate as a coin reflector in such a manner that an impacting inserted coin in the coin slot chamber is reflected by the shoulder elastically in the direction of the front plate and, in the coin slot chamber, experiences a renewed reversal of direction in the direction of the coin channel, wherein, in order to achieve the vibrating coin reflector, the transition regions of the shoulder to a side wall of the coin slot chamber and to a side wall of the coin channel are provided with clearances.

18. Coin slot according to claim 17, wherein the coin slot chamber has a height which is substantially greater than the height of the insertion aperture and the insertion aperture in the front plate is configured in the upper region of the coin slot chamber in such a manner that an inserted coin falls downwardly in an arcuate manner and impacts against the coin reflector and falls further downwardly counter to the insertion direction until it hits the front plate and/or the base of the coin slot chamber and/or experiences a reversal of direction due to gravity.

19. Coin slot according to claim 18, wherein, in order to achieve the vibrating coin reflector, the transition regions of the shoulder to a side wall of the coin slot chamber and to a side wall of the coin channel are provided with clearances.

20. Coin slot according to claim 17, wherein, in the transition regions, the clearances are configured as apertures formed at the height of the coin slot chamber.

* * * * *